US012000262B2

(12) United States Patent
Williams

(10) Patent No.: US 12,000,262 B2
(45) Date of Patent: Jun. 4, 2024

(54) ROD-PUMP CONTROLLER

(71) Applicant: Williams NR Automation LLC, Weatherford, TX (US)

(72) Inventor: Jason Williams, Weatherford, TX (US)

(73) Assignee: Williams NR Automation LLC, Weatherford, TX (US)

( * ) Notice: Subject to any disclaimer, the term of this patent is extended or adjusted under 35 U.S.C. 154(b) by 12 days.

(21) Appl. No.: 17/321,424

(22) Filed: May 15, 2021

(65) Prior Publication Data

US 2021/0363873 A1 Nov. 25, 2021

Related U.S. Application Data

(60) Provisional application No. 63/029,687, filed on May 25, 2020.

(51) Int. Cl.

| | |
|---|---|
| ***E21B 47/009*** | (2012.01) |
| ***E21B 43/12*** | (2006.01) |
| ***F04B 47/02*** | (2006.01) |
| ***F04B 49/02*** | (2006.01) |
| ***F04B 49/06*** | (2006.01) |

(52) U.S. Cl.

CPC ..... *E21B 47/009* (2020.05); *E21B 43/127* (2013.01); *F04B 47/022* (2013.01); *F04B 49/02* (2013.01); *F04B 49/065* (2013.01); *F04B 47/02* (2013.01); *F04B 2201/0801* (2013.01); *F04B 2201/12* (2013.01); *F04B 2201/121* (2013.01); *F04B 2203/02* (2013.01)

(58) Field of Classification Search

CPC .... E21B 47/009; E21B 43/127; F04B 47/022; F04B 47/02; F04B 49/02; F04B 49/065; F04B 17/03; F04B 2201/0801; F04B 2201/121

See application file for complete search history.

(56) References Cited

U.S. PATENT DOCUMENTS

| | | | | |
|---|---|---|---|---|
| 4,507,055 A * | 3/1985 | Fair | ..... | E21B 47/009 417/12 |
| 4,666,375 A * | 5/1987 | Kime | ..... | E21B 47/009 417/46 |
| 4,672,845 A * | 6/1987 | Hirsch | ..... | F04B 47/026 73/152.01 |

(Continued)

*Primary Examiner* — Charles G Freay

(74) *Attorney, Agent, or Firm* — D. Tiller Law PLLC; Don Tiller

(57) ABSTRACT

A rod-pump control device is disclosed. The rod-pump control device uses AMP (current) measurements for electric units, fuel or air usage for gas units, and can use pressure for either unit. The AMP/fuel/air sensors work as the primary trigger to indicate a pump-off condition on an oil and gas well. These sensors can be used as stand-alone triggers or in conjunction with other sensors to more accurately monitor pump efficiency. When the pump-controller starts to indicate an inefficient pump condition, it will turn the pump off by removing power from the electric motor. For gas powered units, the controller will remove power to disengage an electric clutch or send a signal to an engine controller to stop. An adjustable algorithm will use percentage change of off time, dependent on actual run time compared to a user definable target time to keep the pump operating at peak efficiency.

8 Claims, 7 Drawing Sheets

(56) References Cited

U.S. PATENT DOCUMENTS 5,458,466 A * 10/1995 Mills ..... F04B 49/065
417/18
5,820,350 A * 10/1998 Mantey ..... F04B 47/026
417/44.1

* cited by examiner

ROD-PUMP CONTROLLER

CROSS-REFERENCE TO RELATED APPLICATIONS

This application claims the benefit of U.S. Provisional Patent Application No. 63/029,687 filed on May 25, 2020.

BACKGROUND AND SUMMARY

This invention generally pertains to technology for controlling electric and gas-powered rod pumping units that may be used on oil or gas wells. More specifically, the invention pertains to a controller that monitors pump power usage (e.g., current draw on electric powered drives and fuel or air consumption on gas-powered units) and possibly tubing pressure and/or polish rod temperature to indicate pump efficiency. The controller will start and stop the pump, possibly utilizing an algorithm that takes measurements from current usage/fuel usage/air usage and possibly tubing pressure and/or polish rod temperature. The pump-controller will also protect drive belts by turning the unit off if belt slippage is detected during the on cycle. The controller will also contain safety shut-down features for high/low tubing pressure, high/low amp-draw, and/or high/low fuel burn and high polish rod temperature.

Industry standard pump-controllers with the capability to detect a non-pumping situation, i.e. "pumped off," use a variety of sensors such as load cells and encoders which tell a controller that the well is not pumping efficiently or is not pumping at all. These sensors can be expensive to purchase and expensive to install, requiring specialized technicians and equipment. This invention may perform the same function as the costly pump-controllers while utilizing inexpensive electric current, or fuel, air usage detection sensors that are built into or connected to the controller. Embodiments may include a pressure transducer (to send tubing pressure measurements to the controller) or a polish-rod temperature probe (to send polish-rod temperature to the controller). Within the controller, an algorithm uses the electric current/fuel burn/air flow and possibly tubing-pressure data or polish-rod-temperature data. The controller can make changes to pump operation timing parameters, which can, in turn, maintain peak pump efficiency. Operating the pump at peak efficiency will result in increased production and reduced energy use.

Pump-controllers (also called pump-off controllers) have been used in the oil and gas industry for many years. They use sensors to detect a "pumped-off condition." This is a situation that occurs when the pump is not pumping liquid but is still running. This condition may be due to one or more of the following reasons: (1) the liquid entry into the wellbore is slower than the pump's ability to remove the liquid from the wellbore, (2) gas from the well interferes with the pump's ability to lift the liquid (e.g., the pump may be "gas locked," a condition in which gas takes up room in the pump chamber leading to the gas compressing on not entering the tubing when the pump strokes, and gas expanding to prevent the pump chamber from filling when the pump strokes in the opposite direction), or (3) a mechanical failure (e.g., failure in surface equipment such as broken drive belts, broken or seized bearings on the pumping unit, bridle damage or and failure in down-hole equipment such as rod separations, pump failures, tubing leaks, and check valve (traveling valve) failures).

A pumping unit that is in operation but not actively pumping liquid may lead to any of a number of adverse consequences. For example, the energy used by the pump is wasted. This is a significant failing as energy consumption is one of the biggest costs in operating an oil and gas pumping unit. The pumping system may also be subject to premature wear and tear. Again, this is significant as the cost of the production tubing, rod string, downhole pump, and the pumping unit itself can be very expensive, even on shallow wells. When the pump is running while not pumping liquid, the entire system is wearing out at a great cost to the operator. The system may also be subject to additional damage to compromised well components. For example, a pumped-off condition could result in rod separation. If the rods separate and the well continues to pump, it could "slam" the top part of the rod string into the bottom section. This could potentially cause added rod string damage in addition to pump, pumping unit, and tubing damage.

Embodiments of the invention may provide a pump-control device. This device contains an inlet power monitor on electric-powered units and a fuel consumption sensor or air consumption sensor on gas-powered units.

In an electric-unit embodiment, the power inlet connection will feed power to a controller (i.e., a control circuit such as an application specific circuit, a PLC (programable logic controller), or a processor). Controller inputs may include a power-consumption sensor, a tubing-pressure sensor, a casing-pressure sensor, and a polish-rod-temperature sensor. The controller will have the ability to start and stop the pumping unit by turning electric motor power on and off. This can be achieved by running the motor supply power through a contact block.

In a gas-powered-unit embodiment, controller inputs may include a fuel-usage sensor, mass air-flow sensor, tubing-pressure sensor, casing-pressure sensor, and a polish-rod-temperature sensor. The controller will have the ability to start and stop the pumping unit by engaging/disengaging an electric clutch or sending a signal to an engine controller. The controller may be powered by the engine driving a voltage supply or using a solar panel and battery backup.

Both gas and electric embodiments of the rod-pump controller will use the same basic algorithm for controlling the pump. For example, the user will: (1) set a maximum off time not to be exceeded by the algorithm (with a factory-default setting of 3 hours), and (2) set a target off and on time (with a factory-default setting of 30 minutes off/10 minutes on for a period of 40 minutes and a duty cycle of 25%). When the pump turns on, it will run until a pump-off trigger or safety trigger is met. If a safety trigger is met, the unit will not try to restart until the user resets the system. (In an alternative embodiment, the unit may attempt to automatically restart after a period of time following a safety trigger shutdown.) When the pump-off trigger is met, the algorithm will compare the actual run time to the target run time. If the run time exceeded the target time, the off time will be reduced by 10% for the next cycle. If the actual run time does not reach the target run time, the off time will be increased by 10%, not exceeding the maximum off time set by the user. The percentage change this algorithm uses can be adjusted by the user to better control wells with differing pump-off characteristics.

Summary of Exemplary Modes of Operation

Automatic Mode: Use an off-time algorithm to turn the pump on and off in an effort to maximize production and/or minimize energy consumption. All four overriding safety shutdowns may be used during this mode of operation.

Timer Mode: User will enter on and off times. The controller will turn the pump on and off in accordance with these times as long as the overriding shutdowns are allowing the pump to operate and the well has not pumped off (utilizing pump-off triggers). If the well pumps off during the "on" time, the controller will shut down and start the off cycle.

Manual Mode: Simple on/off; possibly a button or switch on the face plate that turns the unit on and off ignoring all overriding safety and pump off triggers.

Summary of Exemplary Pump Off Triggers

Low-Pressure Trigger: A user definable trigger is met for "pump off" pressure or by using a Pressure Trigger Algorithm. One example can be when the pump is started, we allow a user definable delay for the pump to get liquid to surface before we start monitoring for a pumped-off condition. During the off cycle, gas will separate from the liquid in the tubing causing a gas bubble at the top of the liquid column. Other issues like leaking check/traveling valves in the pump mechanism will also cause a bubble that needs to be pumped out of the tubing before monitoring can begin. After the pump-up delay expires, we track the peak pressure of each pump stroke and log the highest stroke pressure to create a plateau. In some cases, it can take several minutes to achieve this plateau as the gas bubbles in the flowline system are partially compressing during the stroke. Once the pressure reaches its plateau, we monitor the difference in pressure from the plateau to the pressure from each stroke of the pump. If the stroke pressure falls below the user-definable trigger setpoint for a user-definable number of strokes, the program will advance to the post pump-off delay timer, then advance to the off cycle.

Current-Draw Trigger (electric-powered pumps): A user definable trigger is met when the current draw stops meeting the "high" set point or "low" set point (in the case the unit is weight heavy). A high amp (current) triggering example will be a unit that normally uses 24.4 amps when traveling in the up position that stops using 24.4 amps and only uses 23.5 amps for the time we allow (~20 seconds), the trigger will shut the unit down on "pump off." An example of low amp draw trigger for units that are "weight heavy" will be monitoring the low amp side of the pump curve. If a unit has a low amp reading of 9.48 amps during normal pumping operations and we start seeing 9.26 amps after a timer (~20 seconds), the trigger for "pump off" will be made.

Fuel-Use Trigger (gas-powered pumps): Similar control parameters will be used for gas-powered units as electric-powered units; fuel usage will be used in place of current draw. Alternatively (or in addition), the system may use air intake for gas-powered units.

Current-Wave Trigger (electric units): On some wells we might not see a decrease in amp draw during the pump stroke (when pumped off) due to the relatively small change in power requirements. In this scenario, the amp draw "wave" (the current-vs-time profile) will be interrupted on the down stroke due to the pump piston impacting the liquid in a partially filled pump chamber. This interruption in the wave will trigger "pump off." One way to see this interruption is by analyzing the current wave (or Amp wave) and triggering off of changes seen in that wave using amplitude and time. For example, one Current/Amp Trigger Algorithm can be when the pump is started, we allow for a pump-up delay to clear any gas pockets that could have formed above the liquid column in the tubing or in the flowline. We then start a learning cycle where we look at a user-definable amount of consecutive rising samples. At this point, we take a time stamp of the rising samples and an amplitude reading. We will then wait for the current/amp wave to drop below saved amplitude reading, this tells us the stroke is completed and we start looking for consecutive rising samples again to get a time/amplitude stamp on the next stroke. We take a user-definable number of samples to average together to generate our baseline. This baseline is compared to all future strokes of the pump. When we see a user definable % change in this time stamp, the program will advance to the post pump-off delay timer, then advance to the off cycle.

Another example of using the amp wave to trigger a pump-off condition is to measure the valley and peak of the wave with a time stamp to get a wave period (sometimes colloquially referred to as "wavelength" in a temporal domain). An algorithm will learn this wave period after an adequate pump-up delay, then use this baseline to compare all future periods during the cycle. When a user definable change is met between the baseline and the running period, the trigger is met, a post pump-off timer is met, and the unit starts the off cycle.

Fuel-Wave Trigger (gas units): Similar to the current-wave trigger, except based on a the fuel-usage or air-usage wave.

Summary of Exemplary Overriding Safety Shut Down

High-Line Pressure: User definable with no timer, shut down immediately when this set point is reached to keep from damaging the sales/flow line from high pressure.

Low-Line Pressure: On a timer, only active when the unit is pumping; this is set below the "pump off trigger" pressure. For example, if a normal flow line pressure is 45 psi while pumping and we trigger a pump off event at 35 psi, we will set the low line pressure to ~15 psi. This should trigger if the flowline fails and we are pumping liquid on the ground. This feature will be on a delay timer to allow a brief change in pressure due to the directional change of the pump.

Belt Alarm (low amp draw/fuel/air usage): Active when "normal" high/low amp or fuel-usage or air-usage trigger is not met within a user definable time. For example, on an electric unit, if the normal up/down cycle shows a max current (amp) draw of 25 amps and minimum of 9 amps, the unit will trigger a belt slippage alarm if 80% (~20 amps) of high amp draw is not met within the allowable time. Gas units will use fuel usage or air usage instead of amp draw to trigger the belt slippage alarm.

High-Polish-Rod Temperature: If the temperature exceeds the user definable set point, the unit will stop.

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
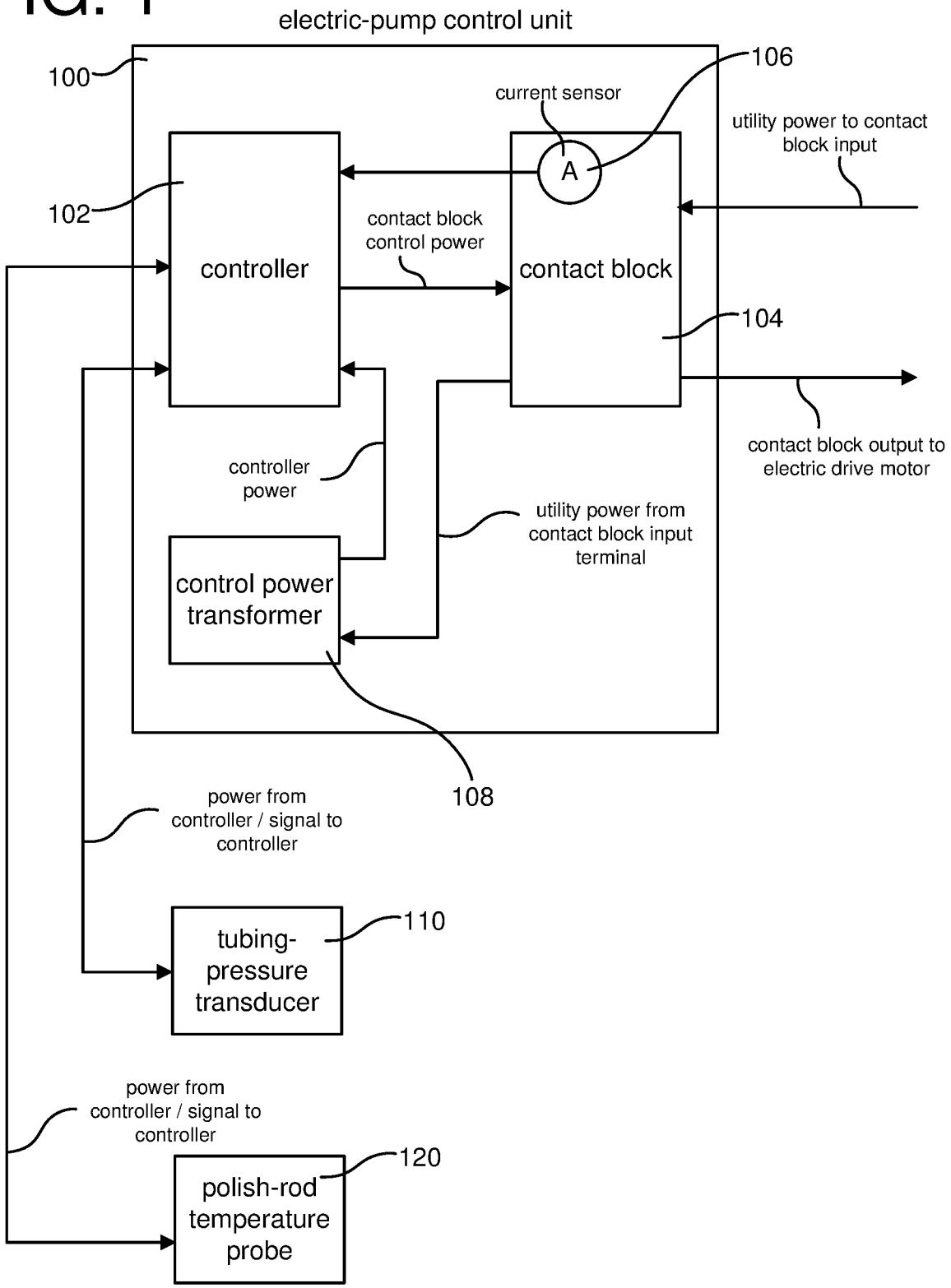
FIG. 1 is a schematic view illustrating an exemplary pump-controller for use with electric pumping units according to an aspect of the invention.

In the summary above, and in the description below, reference is made to particular features of the invention in the context of exemplary embodiments of the invention. The features are described in the context of the exemplary embodiments to facilitate understanding. But the invention is not limited to the exemplary embodiments. And the features are not limited to the embodiments by which they are described. The invention provides a number of inventive features which can be combined in many ways, and the invention can be embodied in a wide variety of contexts. Unless expressly set forth as an essential feature of the invention, a feature of a particular embodiment should not be read into the claims unless expressly recited in a claim.

Except as explicitly defined otherwise, the words and phrases used herein, including terms used in the claims, carry the same meaning they carry to one of ordinary skill in the art as ordinarily used in the art.

Because one of ordinary skill in the art may best understand the structure of the invention by the function of various structural features of the invention, certain structural features may be explained or claimed with reference to the function of a feature. Unless used in the context of describing or claiming a particular inventive function (e.g., a process), reference to the function of a structural feature refers to the capability of the structural feature, not to an instance of use of the invention.

Except for claims that include language introducing a function with "means for" or "step for," the claims are not recited in so-called means-plus-function or step-plus-function format governed by 35 U.S.C. § 112(f). Claims that include the "means for [function]" language but also recite the structure for performing the function are not means-plus-function claims governed by § 112(f). Claims that include the "step for [function]" language but also recite an act for performing the function are not step-plus-function claims governed by § 112(f).

Except as otherwise stated herein or as is otherwise clear from context, the inventive methods comprising or consisting of more than one step may be carried out without concern for the order of the steps.

The terms "comprising," "comprises," "including," "includes," "having," "haves," and their grammatical equivalents are used herein to mean that other components or steps are optionally present. For example, an article comprising A, B, and C includes an article having only A, B, and C as well as articles having A, B, C, and other components. And a method comprising the steps A, B, and C includes methods having only the steps A, B, and C as well as methods having the steps A, B, C, and other steps.

Terms of degree, such as "substantially," "about," and "roughly" are used herein to denote features that satisfy their technological purpose equivalently to a feature that is "exact." For example, a component A is "substantially" perpendicular to a second component B if A and B are at an angle such as to equivalently satisfy the technological purpose of A being perpendicular to B.

Except as otherwise stated herein, or as is otherwise clear from context, the term "or" is used herein in its inclusive sense. For example, "A or B" means "A or B, or both A and B."

FIG. 1 shows a control unit 100 for pumping units that have an electric drive motor. Utility power will come into the unit and connect to the input terminals of the contact block 104. An current (AMP) sensor 106 sends current measurements to a controller 102. The control power transformer 108 input is connected to the utility power input terminal providing constant power to the controller regardless of the contact block position. Output power from the transformer 108 powers the controller 102. The contact block 104 is connected to the controller 102. The controller 102 is connected to, and collects information from, a polish-rod temperature probe 120, and tubing-pressure transducer 110. When the controller 102 starts the pump, it sends control power to the contact block "energizing" an electromagnet, closing the contacts, allowing power to the drive motor. When the motor is running, the controller monitors tubing pressure, polish rod temperature, and current draw. When a "pump off" condition is indicated in the data from one or more sensors, the pump is turned off.

Figure 2:
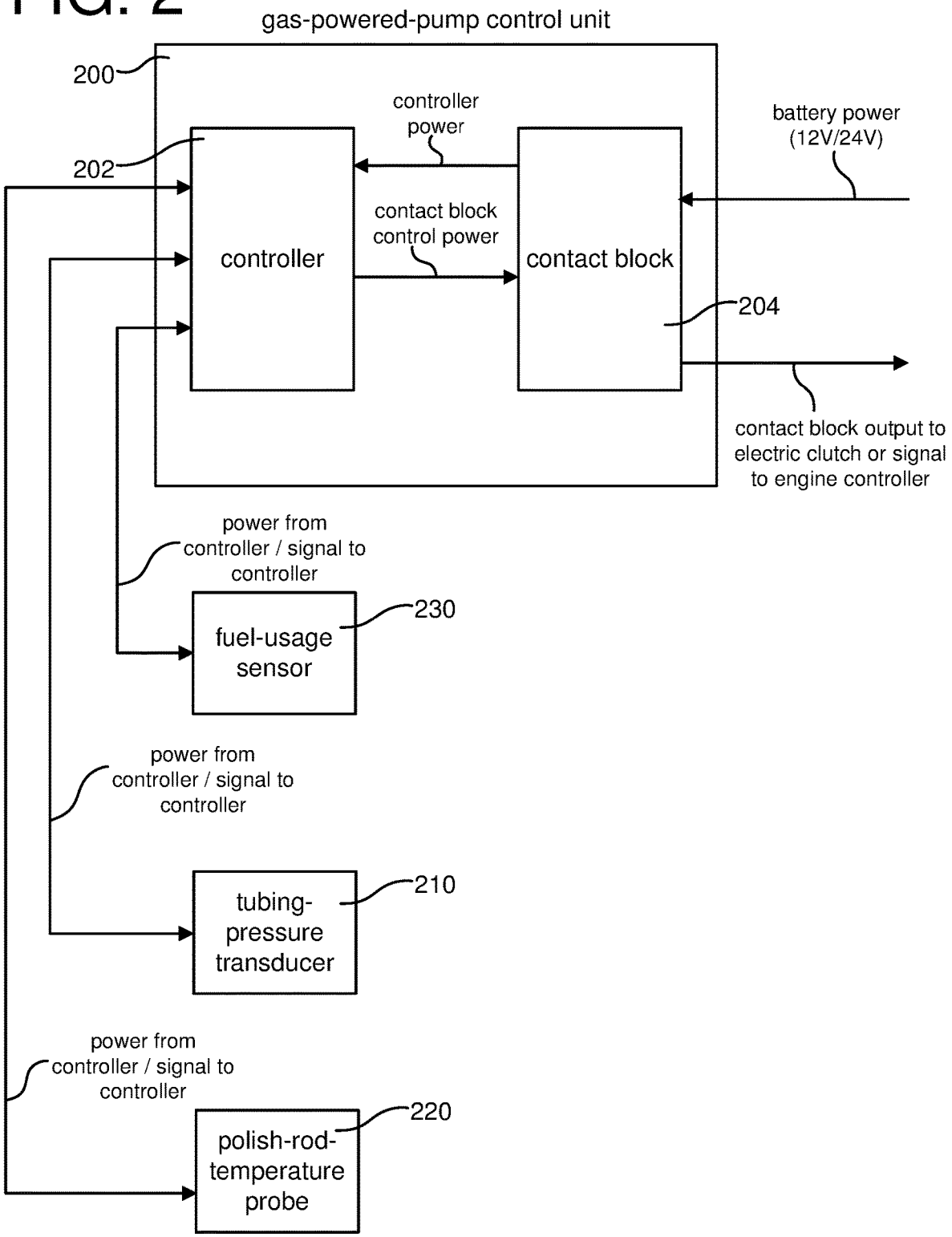
FIG. 2 is a schematic view illustrating an exemplary pump-controller for use with gas powered pumping units according to an aspect of the invention.

FIG. 2 shows a control unit 200 for pumping units that have a gas-powered engine used to operate the pump. Power will be supplied to a contact block 204 from a battery (e.g., 12V or 24V). A controller 202 will get power from the input terminals of the contact block 204 providing constant power to the controller 202 regardless of the contact block position. The contact block 204 is connected to the controller 202. The controller 202 is connected to, and collects information from, a fuel-usage sensor 230, a polish-rod temperature probe 220, and a tubing-pressure transducer 210. (In addition to, or instead of, the fuel-usage sensor 230, the controller may monitor an air-usage sensor such as a mass air-flow sensor to monitor the pump's power consumption.) When the controller 202 starts the pump, it sends control power to the contact block 204 "energizing" an electromagnet, closing the contacts, allowing power to an electric clutch on the pumping unit, starting the pump operation. When the clutch is engaged, the controller 202 monitors tubing pressure, polish rod temp, and fuel/air usage. When a "pump off" condition is indicated in the data from one or more sensors, the pump is turned off.

Figure 3:
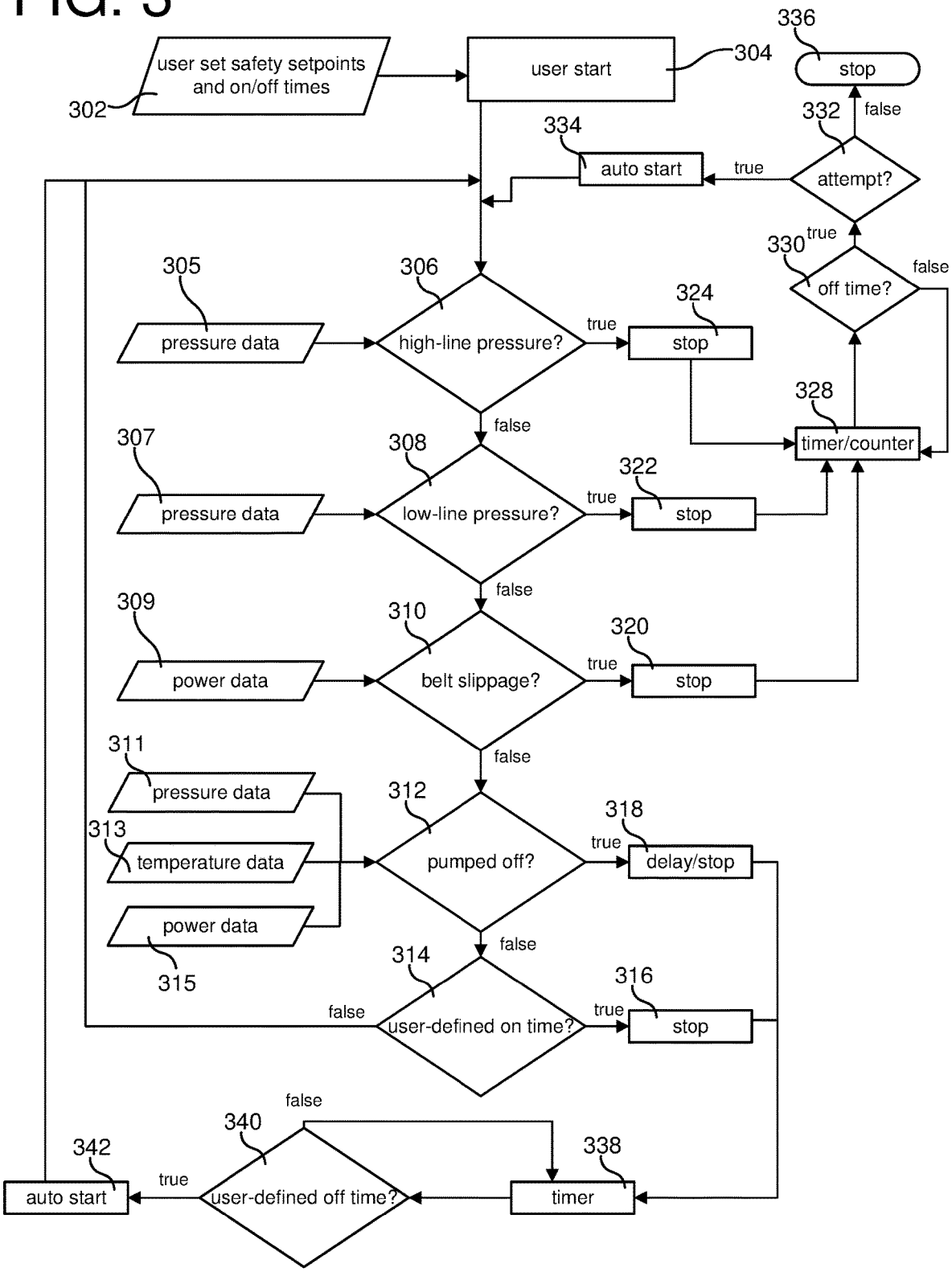
FIG. 3 is an exemplary flow diagram for a timer mode of operation.

FIG. 3 shows an exemplary process flow for a timer mode of operation. Various pressure, temperature, and power-usage data (from sensors/transducers) are used in conjunction with user (or factory) settings to control operation of the pump. The user may establish set points and on/off time operation parameters 302 and start the pump 304. (The user may also proceed with some or all parameters at their default values.) In operation, this exemplary process stops 320, 322, 324 the pump when any of the following three safety conditions is met: (1) the high-line pressure 305 is greater than a set point 306, (2) the low-line pressure 307 is less than the set point 308, and (3) the power usage 309 reaches a belt-slippage-condition set point 310. The exemplary flow will also stop the pump if power usage 315, temperature 313, or pressure 311 indicates a pump-off condition 312. The exemplary flow will also stop the pump if the pump run time reaches the maximum run time set point 314. The user may set a delay before stopping 318 the pump for a pump-off (or other) condition. (The ordering of the condition tests depicted in the flow is not important. They tests may be performed in any order or may overlap in time.) If either the pump-off or the user-defined-run-time condition is met, the pump will automatically restart 342 after the pump has been off for a user-defined (or default) off time 340. The process determines the amount of time the pump has been off 338 and this is compared with the user-defined off time 340 to determine whether to restart the pump 342. If any of the safety-conditions 306, 308, 310 are met, the process may attempt to automatically restart 334 the pump after the off time 328 meets a user-defined (or default) off time 330. In this scenario, the automatic restart 334 may also be conditioned 332 on a maximum number of restarts stopped by a subsequent safety trigger 306, 308, 310. The process will count 328 the number of restarts in this condition and the count will be compared the number allowed 332 to determine whether to automatically restart 334.

Figure 4:
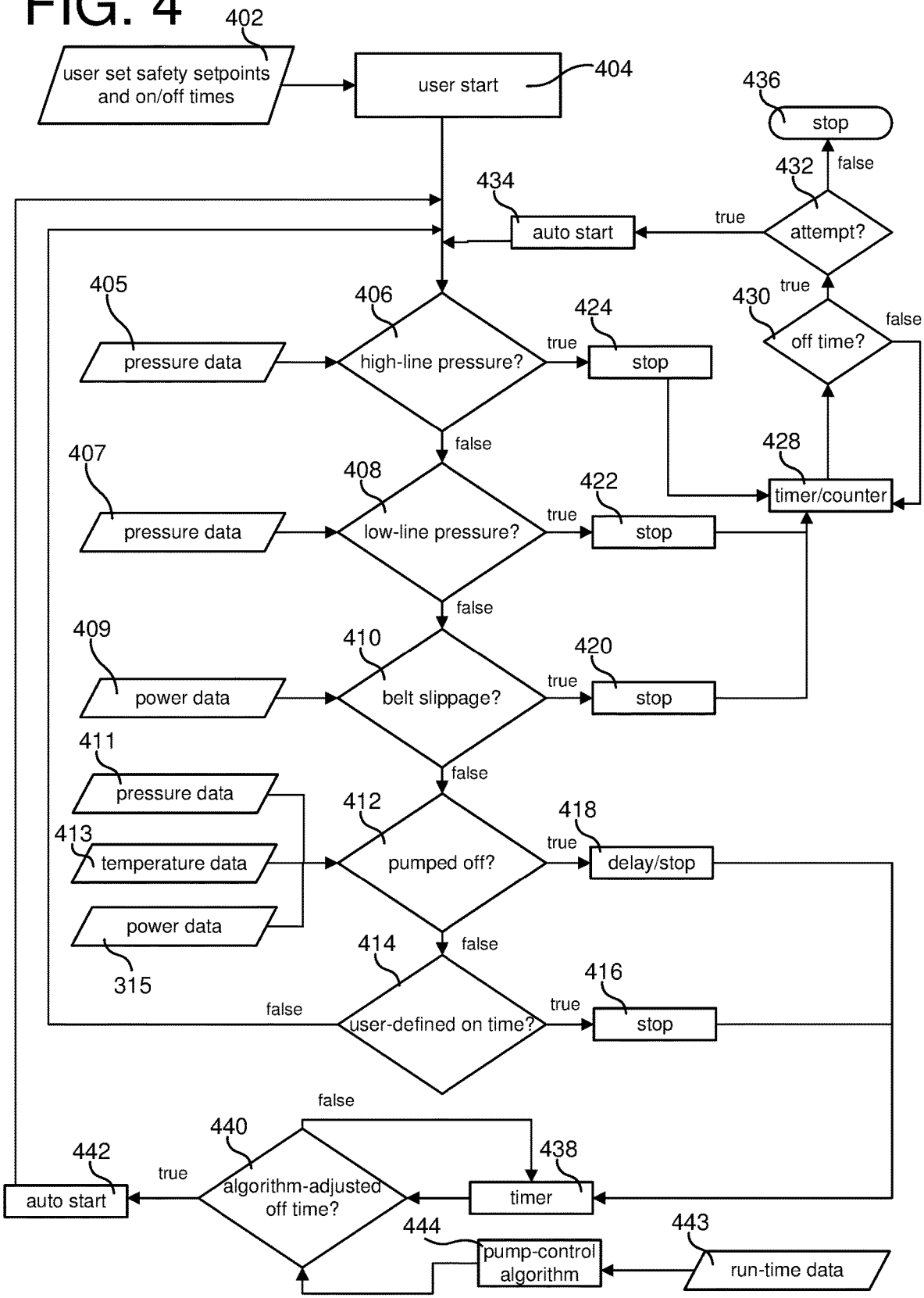
FIG. 4 is an exemplary flow diagram for an automatic mode of operation.

FIG. 4 shows an exemplary flow for an automatic mode of operation. This is similar to the timer mode of operation. The primary difference is that the time the pump is kept off after a pump-off condition trigger is automatically adjusted according to a pump-control algorithm. The user may establish set points and on/off time operation parameters 402 and start the pump 404. (The user may also proceed with some or all parameters at their default values.) In operation, this exemplary process stops 420, 422, 424 the pump when any of the following three safety conditions is met: (1) the high-line pressure 405 is greater than a set point 406, (2) the low-line pressure 407 is less than the set point 408, and (3) the power usage 409 reaches a belt-slippage-condition set point 410. The exemplary flow will also stop the pump if power usage 415, temperature 413, or pressure 411 indicates a pump-off condition 412. Optionally, the exemplary flow will also stop the pump if the pump run time reaches the maximum run time set point 414. The user may set a delay before stopping 418 the pump for a pump-off (or other) condition. (The ordering of the condition tests depicted in the flow is not important. They tests may be performed in any order or may overlap in time.) If the pump-off condition is met, the pump will automatically restart 442 after the pump has been off for calculated period of time 440. The process determines the amount of time the pump has been off 438 and this is compared with a calculated off time 444 to determine whether to restart the pump 442. If any of the safety-conditions 406, 408, 410 are met, the process may attempt to automatically restart 434 the pump after the off time 428 meets a user-defined (or default) off time 430. In this scenario, the automatic restart 434 may also be conditioned 432 on a maximum number of restarts stopped by a subsequent safety trigger 406, 408, 410. The process will count 428 the number of restarts in this condition and the count will be compared the number allowed 432 to determine whether to automatically restart 434.

Figure 5:
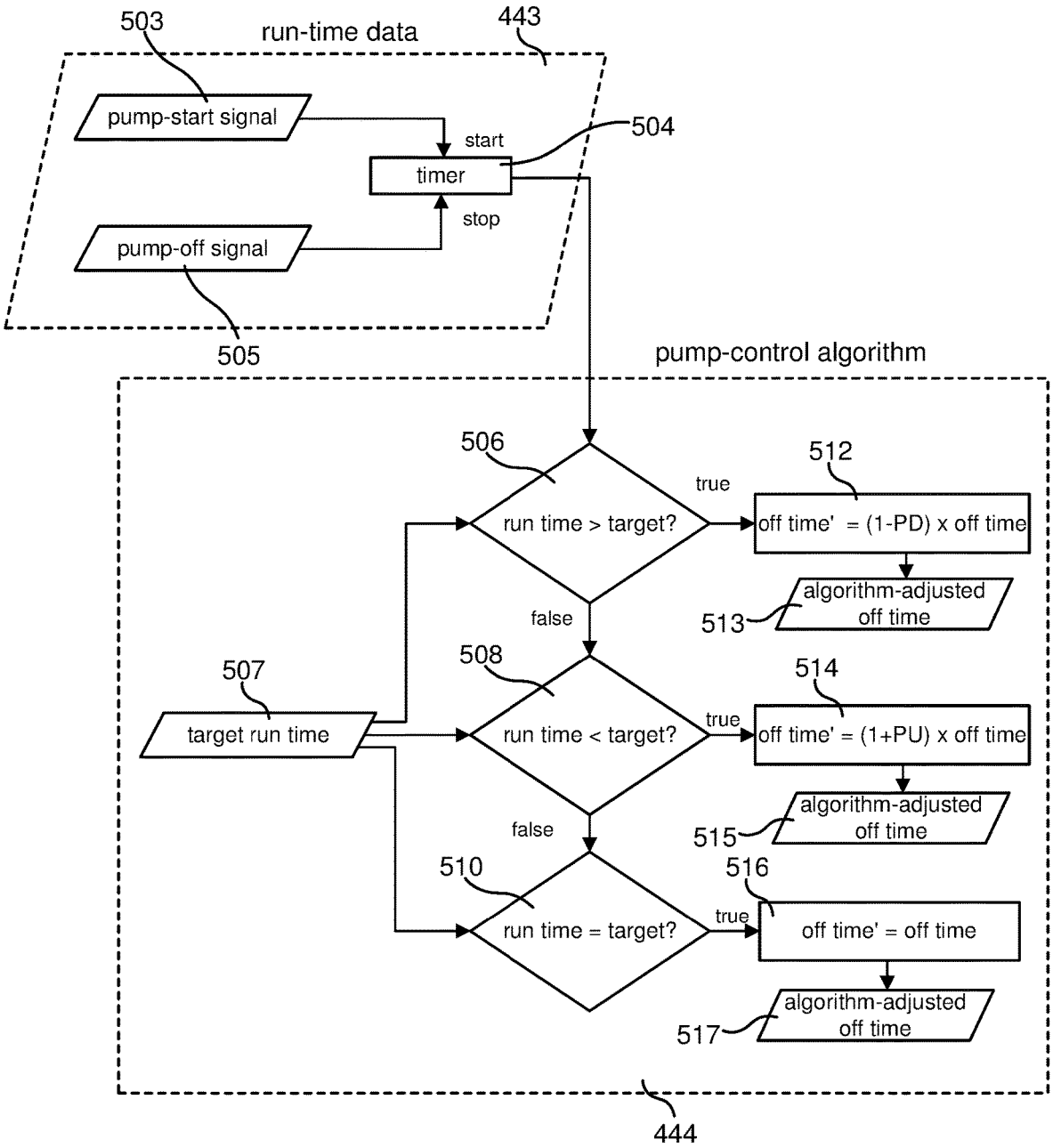
FIG. 5 is an exemplary flow diagram for a pump-control algorithm to adjust the off-time settings for the pump.

FIG. 5 shows an exemplary flow for a pump-control algorithm 444. The algorithm adjusts the time the pump is left in rest after a pump-off trigger based on the user (or factory) defined set point for the run time (the "target run time" 507). If the actual run time 443 before reaching a pump-off event is greater than the target time 507, 506, the off time is adjusted downward by some percentage, "PD" (e.g., 10%) 512, 513. (The actual run time 443 may be determined 504 using the time the pump was started 503 and the time the pump is shut down due to a pump-off condition 505.) If the actual run time 443 before reaching a pump-off event is less than the target run time 507, 508, the off time is adjusted upward by some percentage, "PU" (e.g., 10%) 514, 515. The downward and upward adjustments are not necessarily equal. Nor are they necessarily constant. For example, the adjustments may be functions of the difference between the actual 443 and target 507 run times. If the actual run time 443 is equal to the target run time 507, then the algorithm-adjusted off time is the same as the previously set off time 516, 517. The off time may be adjusted while keeping the overall target period of the pump constant (any modification to the off time is inversely applied to the target run time), in which case the off-time adjustment will modify the target duty cycle of the pump. (target duty cycle=target run time/target period; target period=target run time+off time). The off time may be adjusted while keeping the target run time constant, in which case the off-time adjustment will modify the target period of the pump.

Figure 8A:
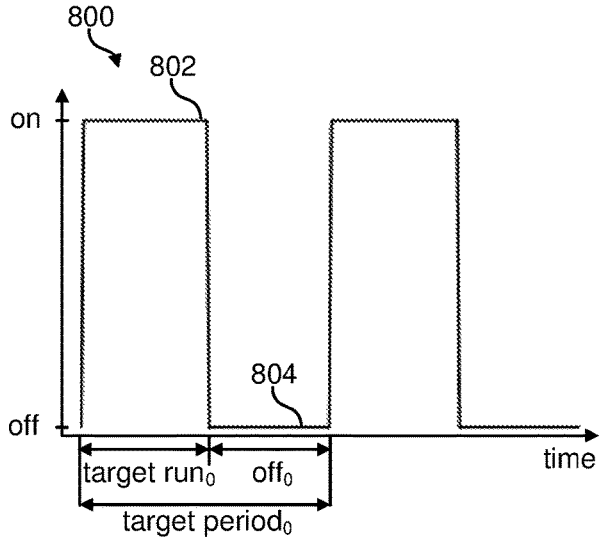
FIGS. 8A-8D depict exemplary operational states of a pump.
Figure 8B:
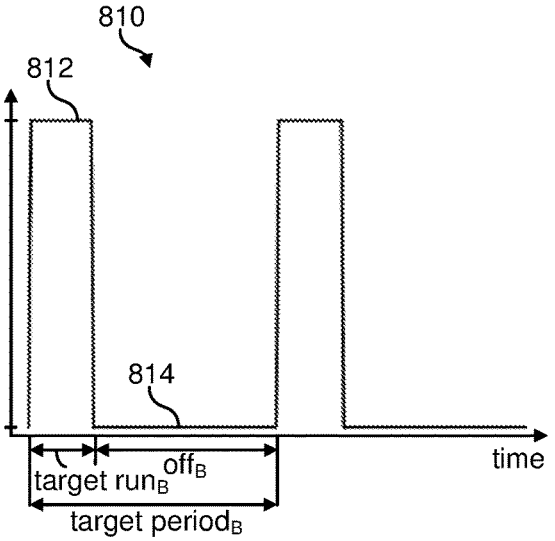
Figure 8C:
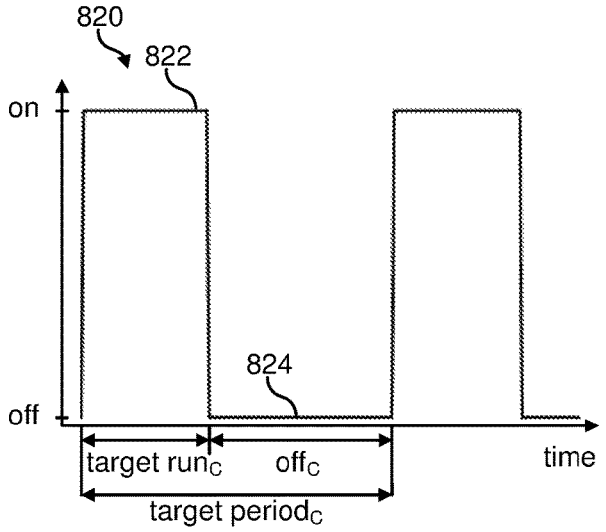
Figure 8D:
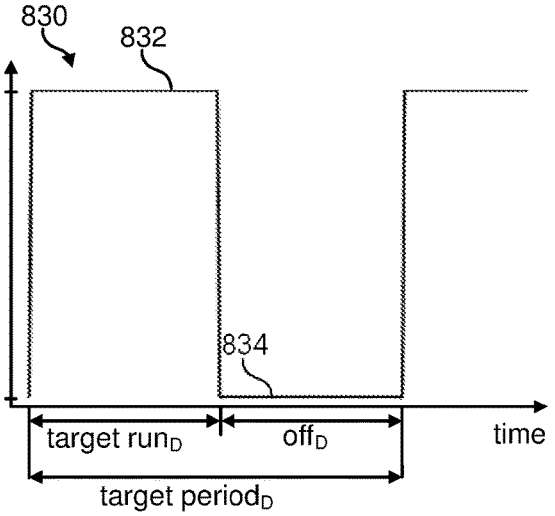

FIGS. 8A-8B illustrate some exemplary potential operations of the pump-control algorithm. FIG. 8A illustrates an exemplary initial-state on-off timing diagram 800. This initial state (state A) includes an initial target run time 802 (target $run_0$), an initial off time 804 ($off_0$), and an initial target period (target period0=target $run_0$+$off_0$). As described above, the initial-state off time 804 ($off_0$) may be modified due to a pump-off event in which the actual run time did not equal the target run time in a number of ways. The modified state 810 illustrated in FIG. 8B includes a target run time 812 (target $run_B$), a modified off time 814 ($off_B$), and a target period (target $period_B$=target $run_B$+$off_B$). In this modified state (state B), the target period is the same as the initial state. Thus, the target duty cycle in state B differs from that in state A. The modified state 820 illustrated in FIG. 8C includes a target run time 822 (target $run_C$), modified off time 824 ($off_C$), and a target period (target $period_C$=target $run_C$+$off_C$). In this modified state (state C), the target run time is the same as for the initial state. Thus, the target period and target duty cycle in state C both differ from that in state A. The modified state 830 illustrated in FIG. 8D includes a target run time 832 (target $run_D$), modified off time 834 ($off_D$), and a target period (target $period_D$=target $run_D$+$off_D$). In this modified state (state D), the target duty cycle is the same as for the initial state. Thus, the target run time and target period in state D differ from that in the initial state.

Figure 6:
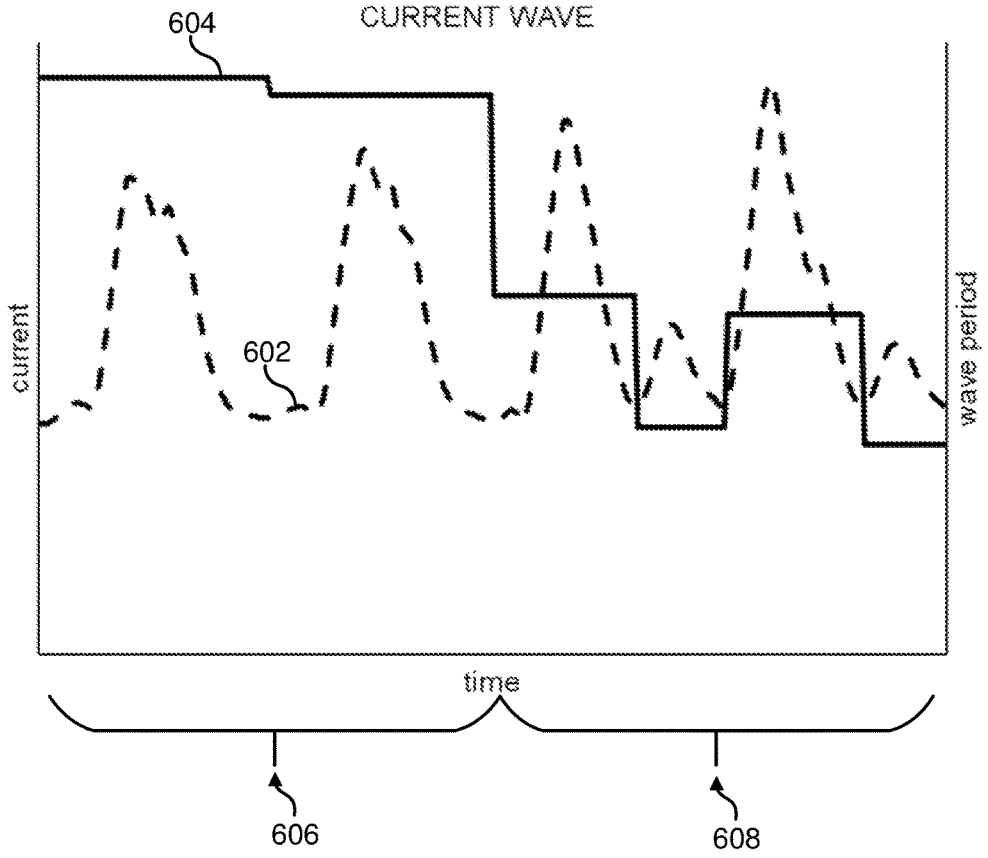
FIG. 6 depicts an exemplary current-vs-time profile (AMP wave) for an electric pump.

FIG. 6 illustrates an exemplary current wave 602 (or amp wave; the current-vs-time profile for pump operation, shown in FIG. 6 with a dashed line). In this example, a wave period is monitored by measuring the trough-to-trough time of the wave. (The length of time between similar features on the waveform may sometimes be referred to in the art as a "wavelength," though it is a temporal rather than a spatial period.) The evolution of the wave period over time 604 is indicated with a dashed line. Early in time 606 (left in the graph), the wave period 604 is at a level that indicates normal operating conditions. Later in time 608 (right in the graph), the wave period 604 has deviated significantly off the normal level (fallen, in this example), indicating a pump-off condition. By monitoring the temporal response of an electric pump's current draw, it is possible to detect a pump-off condition by detecting a change in the temporal response. Similarly, monitoring the temporal response of a gas-powered pump's fuel or air draw (which also indicates power-consumption over time), it is possible to detect a pump-off condition by detecting a change in the temporal response.

Figure 7:
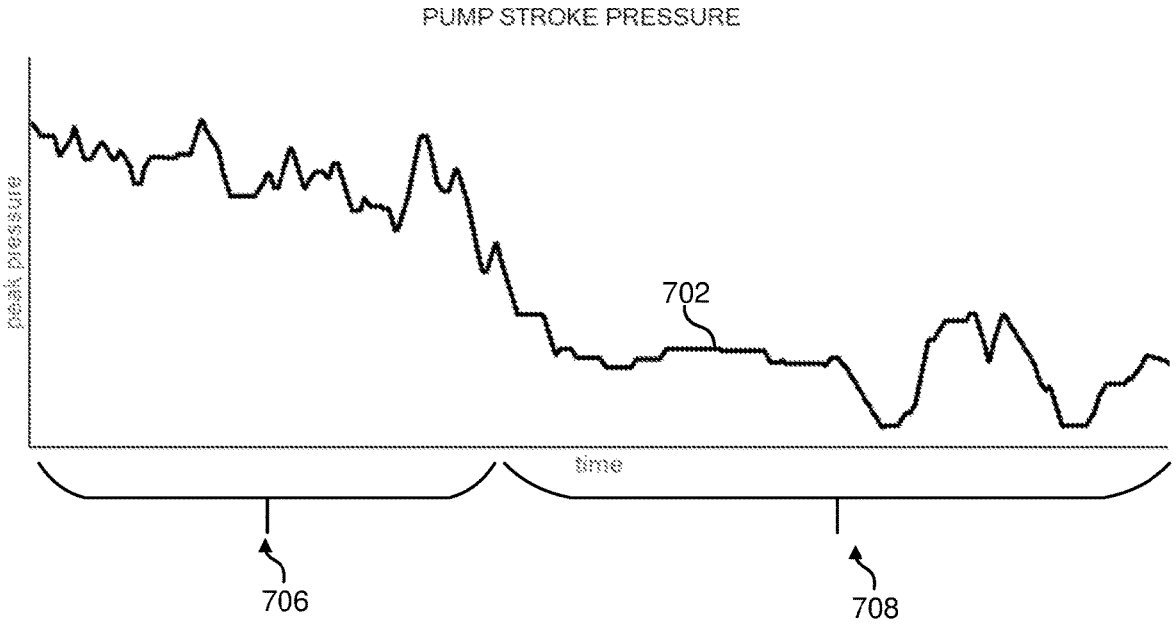
FIG. 7 depicts an exemplary pressure-vs-time profile for a pump.

FIG. 7 illustrates the time evolution of a the peak pressure during a pump stroke 702. Early in time 706 (left in the graph) the peak pressure 702 is at a level that indicates normal operating conditions. Later in time 708 (right in the graph), the peak pressure 702 has deviated significantly off the normal level (fallen, in this example), indicating a pump-off condition. By monitoring the temporal response of the peak pressure, it is possible to detect a pump-off condition by detecting a change in the temporal response.

While the foregoing description is directed to the preferred embodiments of the invention, other and further embodiments of the invention will be apparent to those skilled in the art and may be made without departing from the basic scope of the invention. Features described with reference to one embodiment may be combined with other embodiments, even if not explicitly stated above, without departing from the scope of the invention. The scope of the invention is defined by the claims which follow.

The invention claimed is:

1. A rod-pump control device comprising:

(a) a power sensor configured to measure the power used by a rod pump; and (b) a control circuit connected to the power sensor and configured to read a power measurement from the power sensor and to selectively disable the rod pump based on the power measurement;

(c) wherein the control circuit is configured to modify, using a rod-pump run time and a target run time, at least one of the group consisting of the rod-pump duty cycle, the rod-pump period, and the rod-pump off time.

2. A method for controlling operation of a rod pump, the method comprising:

(a) measuring the power used by the rod pump;

(b) disabling the rod pump based on the measured power;

(c) determining a rod-pump run time; and (d) changing, using the rod-pump run time and a target run time, at least one of the group consisting of a target rod-pump duty cycle, a target rod-pump period, and a rod-pump off time.

3. The method of claim 2 wherein the changing step includes maintaining the rod-pump target duty cycle and applying at least one modification of the group consisting of decreasing the rod-pump off time if the rod-pump run time is greater than the target run time and increasing the rod-pump off time if the rod-pump run time is less than the target run time.

4. The method of claim 2 wherein the changing step includes maintaining the target rod-pump period and applying at least one modification of the group consisting of decreasing the rod-pump off time if the rod-pump run time is greater than the target run time and increasing the rod-pump off time if the rod-pump run time is less than the target run time.

5. The method of claim 2 wherein the changing step includes one of the group consisting of decreasing the rod-pump off time by a first predetermined percentage if the rod-pump run time is greater than the target run time and increasing the rod-pump off time by a second predetermined percentage if the rod-pump run time is less than the target run time.

6. The method of claim 5 wherein the first predetermined percentage is equal to the second predetermined percentage.

7. The method of claim 2 wherein the changing step is one of the group consisting of decreasing the rod-pump off time by a first amount that depends on a difference between the rod-pump run time and the target run time if the rod-pump run time is greater than the target run time and increasing the rod-pump off time by a second amount that depends on a difference between the rod-pump run time and the target run time if the rod-pump run time is less than the target run time.

8. The method of claim 7 wherein the first amount is equal to the second amount.

* * * * *